US005174411A

United States Patent [19]

Oliver et al.

[11] Patent Number: 5,174,411

[45] Date of Patent: Dec. 29, 1992

[54] LADDER IMPROVEMENTS

[75] Inventors: David P. Oliver, Saltash; David Shrimpton, Launceston, both of England

[73] Assignee: Abru Aluminium Limited, United Kingdom

[21] Appl. No.: 765,817

[22] Filed: Sep. 26, 1991

[30] Foreign Application Priority Data

Sep. 28, 1990 [GB] United Kingdom ..... 9021129
Aug. 9, 1991 [GB] United Kingdom ..... 9117250

[51] Int. Cl.[5] ..... E06E 9/00
[52] U.S. Cl. ..... 182/77; 182/98
[58] Field of Search ..... 182/76–81, 182/209, 98

[56] References Cited

U.S. PATENT DOCUMENTS

| | | | |
|---|---|---|---|
| 1,621,539 | 3/1927 | Hemingway | 182/77 |
| 1,811,709 | 6/1931 | Bessler | 182/80 |
| 2,580,978 | 1/1952 | Triller | 182/80 |
| 2,931,456 | 4/1960 | Harmon | 182/80 |

FOREIGN PATENT DOCUMENTS

| | | | |
|---|---|---|---|
| 6700067 | 7/1968 | Netherlands | 182/79 |
| 176199 | 6/1935 | Switzerland | 182/80 |
| 857353 | 12/1960 | United Kingdom | 182/98 |

*Primary Examiner*—Alvin C. Chin-Shue
*Attorney, Agent, or Firm*—Banner, Birch, McKie & Beckett

[57] ABSTRACT

A loft ladder which can be pivotally and slidably mounted to loft opening has counterbalancing means including a resiliently biased pivotal arm, connected to the loft ladder by a link member pivotally connected between the pivotal arm and the loft ladder to allow the ladder to turn about is pivotal connection to the loft opening over at least a limited extend. The arm has a two-stage resilient biasing spring offering a greater resilient force over part of the range of movement of the arm. A hand rail of the ladder is supported on a section of the ladder by spacers allowing the hand rail to be carried at a lateral distance from the ladder stile greater than the lateral space occupied by the counterbalance mechanism. A releasable catch for retaining two ladder parts in a selected position comprises two moveable catch members mounted on respective stiles, and interconnected together.

15 Claims, 6 Drawing Sheets

LADDER IMPROVEMENTS

The present invention relates generally to ladders, and particularly to an extending ladder having a number of features which facilitate its use and make it more convenient to operate.

The present invention finds particularly utility in connection with extending ladders of the type mounted in a loft opening and generally known as loft ladders. Our earlier UK patent 2,133,827 describes a storable ladder having at least one ladder section, and pivotable mounting means for mounting the ladder to a fixed support member such as a hatchway edge in which the ladder is relatively movable longitudinally of its length in relation to the pivotable mounting means operable to resist longitudinal movement of the ladder with respect to the mounting means, the frictional restraining means being capable of exerting a force great enough at least substantially to retain the ladder against movement longitudinally of its length with respect to the mounting means under the action of its own weight. Modern storable ladders of this type are almost without exception made of lightweight materials such as aluminium or an aluminium alloy. Such materials have great strength in relation to their weight and the lightness of such ladders is a considerable advantage for the particular application referred to above.

Because modern storable ladders are made of lightweight materials such as aluminium or an aluminium alloy, frictional restraint of the type described in this earlier UK Patent made it easier for the user to raise and lower a ladder since during the operation of raising or lowering the ladder it was not necessary fully to support the weight of the ladder at all times and, should the operation be interrupted for any reason, the ladder would remain in the partly raised or partly lowered position reached at the time of the interruption.

This device had a small disadvantage, however, in that the weight of the ladder always acts in one direction so that when lowering the ladder the weight assisted the operation and required only a low force to be exerted by the operator, whilst raising the ladder involved overcoming not only the weight of the ladder but also the frictional resistance exerted by the frictional restraining means. Although these forces are not large, it was sought to avoid them by seeking some form of unidirectional frictional resistance or resistance greater in one direction (namely against lowering of the ladder) than in the other direction (namely raising the ladder). Such unidirectional frictional restraints have not, however, been successful and even so would still leave the full weight of the ladder to be raised by the operator when moving it to its stored position. For this reason it has been proposed to introduce a counterbalancing mechanism to the ladder, which will partly support the weight of the ladder so that less force is required to raise the ladder than to lower it. Such counterbalancing mechanisms can still equally well be used with frictional restraint means of the type described in our UK Patent 2,133,827.

One way in which counterbalancing can be achieved in such a ladder system comprises the provision of a pivoted arm mounted on the floor of the loft and connected at its free end to the upper end of the ladder, with a biasing spring urging the arm to rotate in the direction corresponding to raising of the ladder. When a ladder equipped with such a counterbalance means is lowered, however, the three pivotal connections, namely the pivotal connection of the ladder to the hatchway opening, the pivotal connection of the arm to the loft floor, and the pivotal connection of the ladder to the arm, form a triangle which rigidly defines the position of the loft ladder in a manner which can be inconvenient for the user since, in raising the ladder, the ladder must follow a single fixed path determined by the mechanism.

The present invention seeks to provide means by which this problem can be overcome.

According to one aspect of the present invention, therefore, there is provided a loft ladder of the type adapted to be pivotally and slidably mounted to a loft opening, and having counterbalancing means including a resiliently biased pivotal arm, in which a free end of the pivotal arm is connected to the loft ladder by a link member pivotally connected at one end to the pivotal arm and at the other end to the loft ladder or a member thereof whereby to allow the loft ladder to turn about its pivotal connection to the loft opening over at least a limited extent when the loft ladder is in the lowered position.

In this lowered position the loft ladder of the present invention can be adjusted slightly in position forwards or backwards as allowed by the pivotal link connection to the arm, and this greatly facilitates positioning it upon lowering and eases the operator's is task upon raising.

In a preferred embodiment of the invention the said link member comprises two link elements positioned one on either side of the said pivoted arm and joined together by the pivotal connectors by which the link member is connected to the said arm and the loft ladder or member thereof.

The resilient biasing of the pivoted arm of the counterbalance means may be effected, for example, by means of a coil spring in torsion.

One of the problems associated with utilizing spring-biased counterbalanced mechanisms lies in the fact that although the restoring force on the spring is proportional to its deflection (or torsion in the case of a torsion spring) the proportionality constant does not vary in the same way as the load on the counterbalance mechanism in that, when the ladder is fully extended, the full weight of the ladder is suspended on the counterbalance mechanism and this changes little as the ladder is raised until it reaches a point where the ladder pivots about the pivotal connection to the hatchway, at which point the load reduces considerably in a short distance as the pivotal movement transfers the majority of the weight of the ladder onto the pivotal connection to the hatchway. Furthermore, shortly before reaching the fully stowed position, practically none of the weight of the ladder is borne by the counterbalance mechanism: indeed, depending on the size of the opening and the distance between the hatchway and the floor (which determines the position along the uppermost section of the ladder at which the pivotal connection to the hatchway is located in the stored position) a major part of the loft ladder may be positioned above rather than below the pivotal connection so that the turning movement exerted by the weight of the ladder is in fact in the same direction as the force exerted by the counterbalancing means rather than in opposition thereto. This can result in the counterbalance mechanism acting to "snatch" or sharply jerk the loft ladder into the last stages of the stowage movement, and considerable care has to be exercised in selecting the appropriate spring force which will avoid excessive snatch forces being exerted at the upper end of the range of movement whilst nevertheless offering a significant assistance in supporting the weight of the ladder as it reaches the lower end of its range of movement.

In another aspect of the present invention a solution to this problem is offered.

According to a second aspect of the present invention, therefore, a loft ladder of the type adapted to be pivotally and slidably mounted to a loft opening and having counterbalancing means including a resiliently biased pivotal arm, is provided with a two-stage resilient biasing means offering greater resilient biasing force when the arm is in a position where it largely supports the weight of the ladder and less biasing force when the ladder is in a nearly stowed position.

A loft ladder incorporating a resiliently biased counterbalance mechanism such as that defined above, may conveniently include a coil spring acting in torsion to exert the resilient biasing force. The two-stage operation may be achieved by utilizing a two-stage spring. namely a spring which is formed as a composite of two spring elements one of which acts only over a limited part of the range, and is brought into play by suitable abutment means engaging the spring as the loft ladder passes the position appropriate for its introduction or release (depending on the direction of movement).

In one embodiment of the present invention the two-stage action is provided by a helical coil spring acting in torsion about the axis of the coil and provided with a central core or sleeve of resilient elastomeric or plastics material which is gripped by the coil spring as it is reduced in diameter upon flexing. In this way, by suitably choosing the diameters of the coil spring and the sleeve, and by appropriately positioning the coil spring it can be arranged that the coil spring alone exerts a resilient biasing force on the pivotal arm of the counterbalance mechanism during the latter part of the raising movement of the ladder, between the position where the weight of the ladder is largely taken by the pivotal connection to the hatchway edge and the fully stowed position, so that a relatively light biasing force is exerted over this part of the movement, by the combined action of the coil spring and the resilient sleeve which is gripped and compressed by the coil spring as it becomes reduced in diameter upon flexing and is sufficiently great to support substantially the whole of the weight of the ladder as it moves from this intermediate position to the fully lowered position.

For economy it is preferred that a single counterbalance mechanism incorporating a single pivotal arm is utilized, although a counterbalance mechanism having two such arms one on each side of the ladder may be employed if desired. Most loft ladders are provided with a handrail, at least over the upper part of the ladder (the lower end of which hand rail is at shoulder height for a user standing on the ground and about to mount the ladder) and it is usual for such hand rail to be mountable on one side of the ladder or the other to take account of the particular circumstances of use in different establishments. However, because the pivotal arm must be allowed to swing closely adjacent one side of the loft ladder as it reaches the fully raised position, such hand rail would foul the arm unless it were always on the opposite side of the ladder from that on which the biasing arm is positioned. However, there may be envisaged circumstances in which there are external constraints on both the position of the biasing arm and that of the hand rail, and in order to avoid unnecessary limitations on the mounting of the loft ladder of the present invention there are provided, according to another aspect, means by which the hand rail and the counterbalance mechanism may be placed on either side of the ladder at will without interfering with one another.

According to a further aspect of the present invention, therefore, a loft ladder having pivotal slide coupling means for mounting it to a loft opening and a counterbalance mechanism with a resiliently biased pivotal arm, is provided with a hand rail supported on the ladder or a section thereof by spacers allowing the handrail to be carried at a lateral distance from the stile greater than the lateral space occupied by the counterbalance mechanism allowing the hand rail to be fitted to the same side of the loft ladder if desired.

The present invention further includes another feature which improves its ease of use and convenience for an operator. According to this further aspect of the invention a loft ladder having pivotal slide coupling means for mounting it to a loft opening and a counterbalance mechanism for taking at least part of the weight of the ladder as it is lowered, is provided with resilient buffer means on at least one and preferably both stiles in a position to contact the said pivotal slide coupling as the ladder approaches the stowed position. The resilient buffer means may include a compression spring engaged between a buffer housing and a slide member. The buffer housing is preferably formed as an open channel having at least one guide projection extending from the bottom of the channel into the region between two side walls thereof, and the slide member preferably has a longitudinal slot into which the guide projection engages for the purpose of guiding rectilinear displacement of the slide member and limiting the travel thereof. A second projection spaced along the channel serves as an abutment for engaging one end of the compression spring, the other end of the spring being engaged by an abutment surface on the buffer slide member. In a preferred embodiment the buffer slide member has a second longitudinal slot housing the said spring, the said abutment surface being constituted by an end face on the slot.

With reference to yet a further feature of extendable ladders, these are provided with a catch between each adjacent pair of relatively movable ladder parts or sections, and such ladders may, typically, be formed as two-part or three-part ladders: the catch operates to retain the adjacent ladder sections in either the extended or retracted positions. As described above, counterbalancing means are provided for taking a part of the weight off the loft ladder to assist an operator in raising and lowering the ladder by reducing the forces which have to be exerted, especially in raising the ladder and a particular improvement provided by the present invention lies in the manner in which the counterbalancing means are linked to the upper end of the loft ladder allowing it a degree of movement in the fully extended position in order to facilitate its positioning by the operator. It will be appreciated that, in the fully extended position, the ladder forms a predetermined angle to the vertical and it is, therefore, possible to fit the above mentioned catch between adjacent ladder sections in a predetermined position providing the drop between the ceiling and the floor is known, together with the inclination at which the ladder is to lie. In order to accommodate variations in these parameters, however, loft ladders are usually provided with a plurality of different engagement positions between adjacent ladder sections and this, together with the fact that, for economic reasons, the material thickness is reduced to the minimum, can result in a certain weakness in the engagement between the catch and the ladder sections interconnected thereby. Although it would be possible to increase the strength by increasing the material thickness, this would have an economic disadvantage which is unacceptable.

The present invention seeks to provide means by which the engagement of interconnection means acting between two adjacent sections of an extending ladder can be achieved securely without increasing the material thickness. Although the present invention will be described hereinafter with specific reference to its application to a loft ladder it will be appreciated that this description is provided by way of example only and without limitation to the generality of the invention which may be applied to any form of extending ladder.

According to another aspect of the present invention, therefore, an extending ladder having at least two ladder parts and a releasable catch for retaining the ladder part in at least one selected, extended or partly extended relative position, is provided with two movable catch members mounted on respective stiles of one of the ladder parts and interconnection means linking the two movable catch members such that displacement of one member is transmitted to the other whereby to release the two ladder parts for relative movement or to connect them together in a selected, relative position.

In a preferred embodiment of the invention each catch member has a nose portion engageable into at least one co-operating opening in the corresponding stile of the other ladder part.

The catch members may be of any suitable form: in particular the catch members may be rectilinearly displaceable between a first or engaged position and a second or release position, all alternatively may be angularly displaceable between such first and second positions.

The interconnection means linking the two movable catch members preferably passes through a hollow rung of the ladder from one stile to the other. This has the advantage that no external parts of the catch member occupy the space between the two stiles and, consequently, avoids the risk of any encumbrance to the operator.

When applied to a loft ladder as described above, the double catch arrangement of the present invention offers the user the same level of convenience in operation, namely the possibility of releasing the catch, utilizing only one hand whilst nevertheless fulfilling its primary function of providing a secure engagement, which, even under load will not tear or deform the material of the ladder stile into which the catch member is engaged.

The interconnection means passing through the said hollow rung of the ladder may take any suitable form for transmission of forces, including tensile, compressive or torsional forces. In the preferred embodiment of the invention the force transmission is effected by means of a torsion bar of torsion tube within the rung. In such an embodiment it is preferred that a lever arm is provided to operate the said torsion bar or tube whereby to cause displacement of the catch members between the said first position and the said second position thereof.

The said lever arms are preferably formed as respective operating handles for the catch members and, in the preferred embodiment, the lever arms are formed as second order levers between the torsion bar and the catch members themselves. Engagement between the second order lever arms and the catch members may be facilitated if the latter are formed as resiliently biased sliding bolts since engagement may, in such an arrangement, be achieved simply by means of a slot and pin connection between the bolt and the lever arm.

Three embodiments of the present invention will now be more particularly described, by way of example, with reference to the accompanying drawings, in which.

Figure 1:
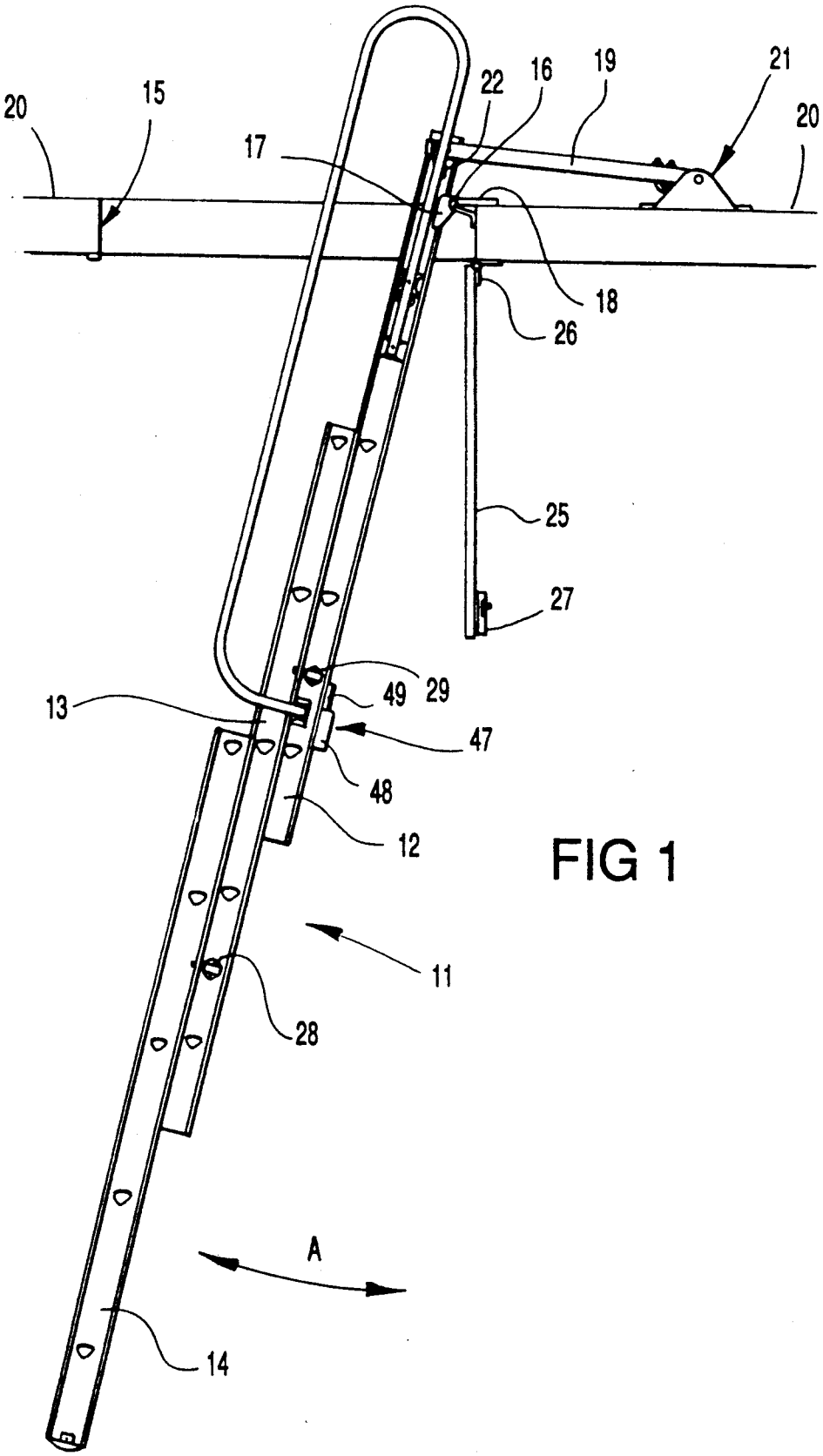
FIG. 1 is a side view of a three section loft ladder formed as an embodiment of the present invention and shown in the lowered position.

Referring now to the drawings, FIG. 1 illustrates a loft ladder generally indicated 11 in the lowered position. The loft ladder comprises three sections 12, 13, 14 the stiles of which are formed from I-section comprising a central web with opposite transverse flanges shaped to engage one another to allow relative sliding of the adjacent sections 12, 13, 14. Although three sections have been illustrated in the embodiment it will be appreciated that a greater or smaller number of ladder sections may be employed. The upper ladder section 12 is connected to the edge of the hatchway opening 15 by a mount comprising a guide 17 which engages one edge of the ladder section 12 to allow the ladder section 12 to slide with respect thereto: the guide 17 is pivotally connected to a bracket 18 by a pivot 16, and the bracket 18 is secured fixedly in position on the hatchway edge. The components comprising the guide 17, the pivotal connection 16 and bracket 18 may be of the type described in our earlier UK Patent 2,133,827. The upper ladder section 12 is also provided with a resilient buffer 47 having a housing 48 and a buffer slide member 49, which will be described in more detail in relation to FIGS. 5 to 8.

A counterbalance arm 19 is secured to the floor 20 of the loft in which the hatchway opening 15 is formed by a resilient biasing mechanism generally indicated 21, which in this embodiment simply comprises a coil spring (not shown) operating in torsion, engaged between a fixed housing and the counterbalance arm 19. The arm 19 itself is connected by a pivotal link 22 to the upper end of the ladder section 12. The pivotal link 22 is joined by a pivotal connection 23 to the upper end of the ladder 12 and by a pivotal connection 24 to the free end of the pivoted arm 19 of the counterbalance mechanism. The link 22 allows the ladder 11 to be adjusted in position about the pivotal connection 16 to the hatchway edge in the direction indicated by the double arrow A of FIG. 1, and this link also allows appropriate adjustments to be made to the stowage position as will be described in relation to FIG. 2.

Finally, a hatchway cover 25 is shown in FIG. 1 hingedly connected by a hinge 26 to the hatchway opening 15 and provided with a bolt 27 by which the hatch cover 25 can be held in a closed position.

Figure 2:
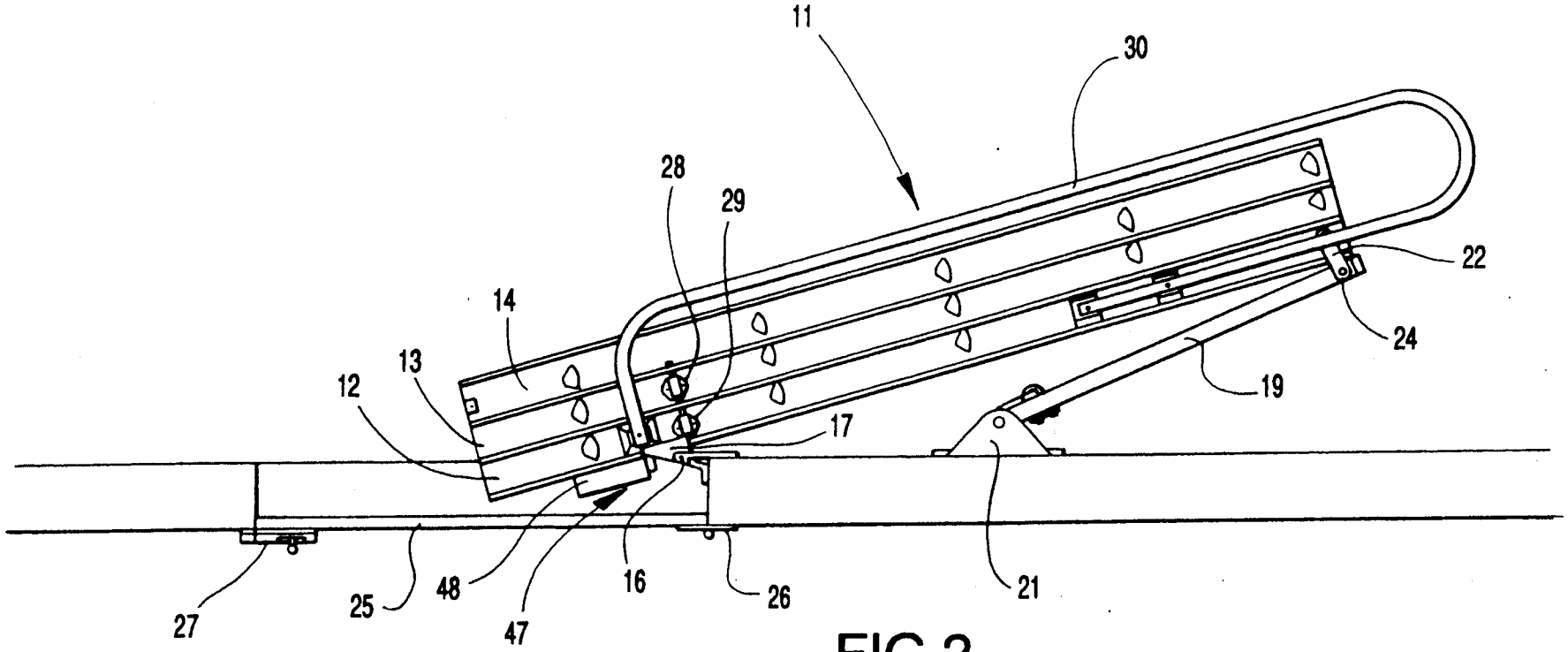
FIG. 2 is a side view of the loft ladder of FIG. 1 shown in the fully stowed position.

In FIG. 2 the ladder 11 is shown in its fully raised position in which, as will be seen, the resilient biasing mechanism 21 has turned the pivoted arm 19 of the counterbalance mechanism clockwise in relation to the position occupied in FIG. 1, drawing the ladder section 12 along the guide 17 and pivoting it about the pivot 16 to a position inclined at a shallow angle to the horizontal. The ladder section 14 is freely slidable along the ladder section 12 and the ladder section 14 is freely slidable along the ladder section 14 by suitable interengagement means, again of a type such as that described in our earlier UK Patent 2,133,827 (or any other suitable telescopically slidable interconnection) and there are provided releasable locking means 28, 29 for latching or locking the ladder sections in the closed positions. The same latching or locking means 28, 29 may also act to lock the ladder sections 12, 13, 14 in their respective extended positions. For this purpose the locking means 28, 29 may comprise spring-loaded bolts engageable into appropriately positioned openings 115, 116, 120 or 121 in flanges of the ladder sections 13, 14. More specifically, the bolts 28, 29 engage the openings 115, 116 when the ladder is extended while, in the collapsed position of the ladder, they engage the openings 120, 121. Furthermore, as the ladder reaches the position shown in FIG. 2 the buffer 47 engages the guide 17 to act as a limit stop determining the end of the movement and also to absorb the impact upon deceleration of the ladder, to avoid a harsh or jarring impact as the ladder reaches the end of its travel. It is important that this buffer is accurately positioned to prevent the counterbalance mechanism from drawing the ladder too far into the loft space which would make it difficult for the user to displace it from the stowed position.

Figure 3:
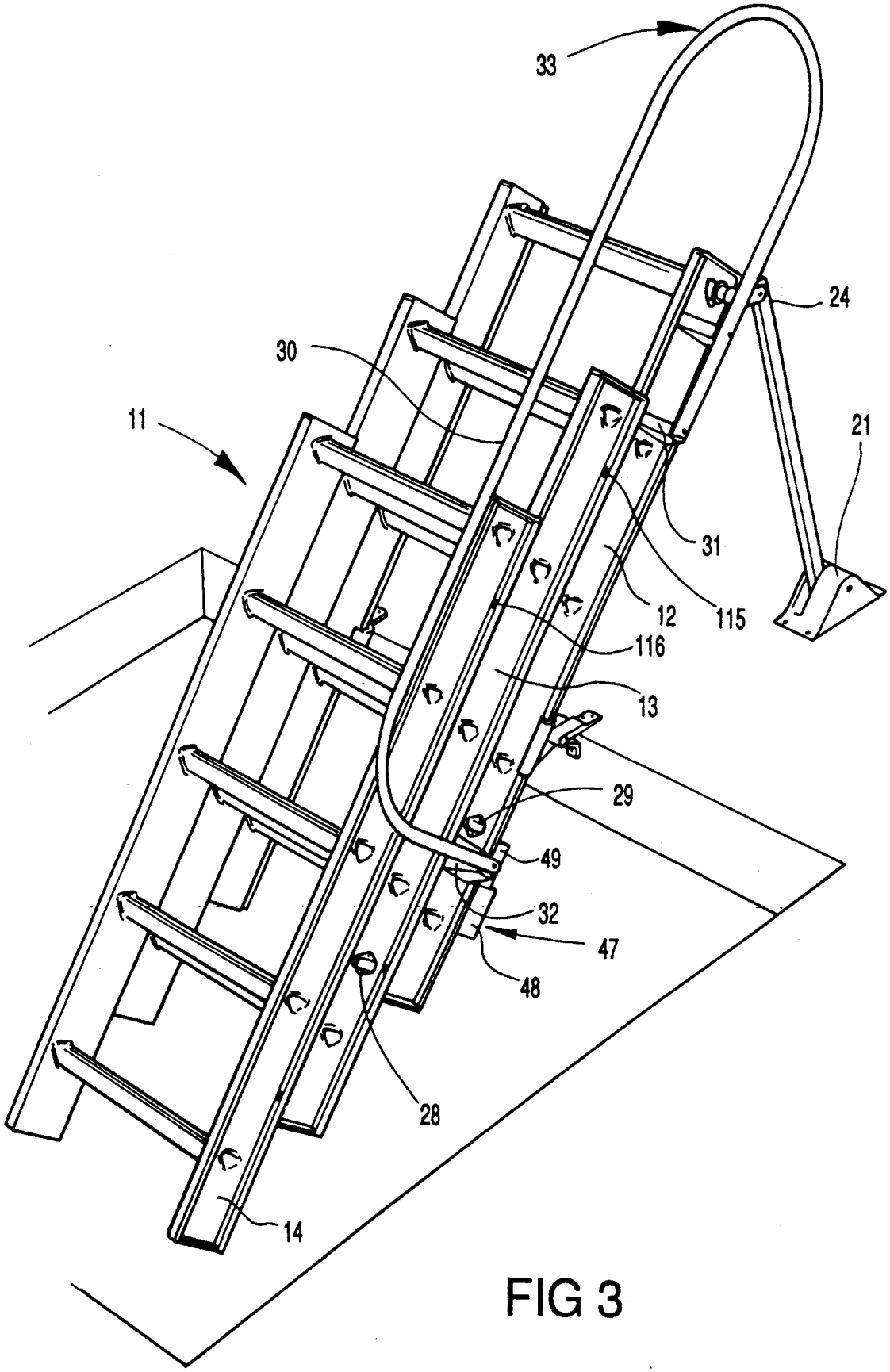
FIG. 3 is a perspective view of the ladder illustrated in FIGS. 1 and 2 shown in an intermediate position.

As also shown in FIGS. 1 and 2, the upper ladder section 12 has a hand rail 30 which, as can be seen more clearly in FIG. 3, is attached to the upper ladder section 12 by two spacers 31, 32 which hold the hand rail 30 laterally away from the stile of the ladder section 12 leaving sufficient space for the pivoted arm 19 to pass between an upper loop 33 of the hand rail 30 and the ladder stile itself so that both the hand rail and the counterbalance mechanism can be positioned on the same side of the ladder if required. This does not, of course, preclude the hand rail and the counterbalance mechanism being positioned on opposite sides of the ladder should this be preferred.

Figure 4:
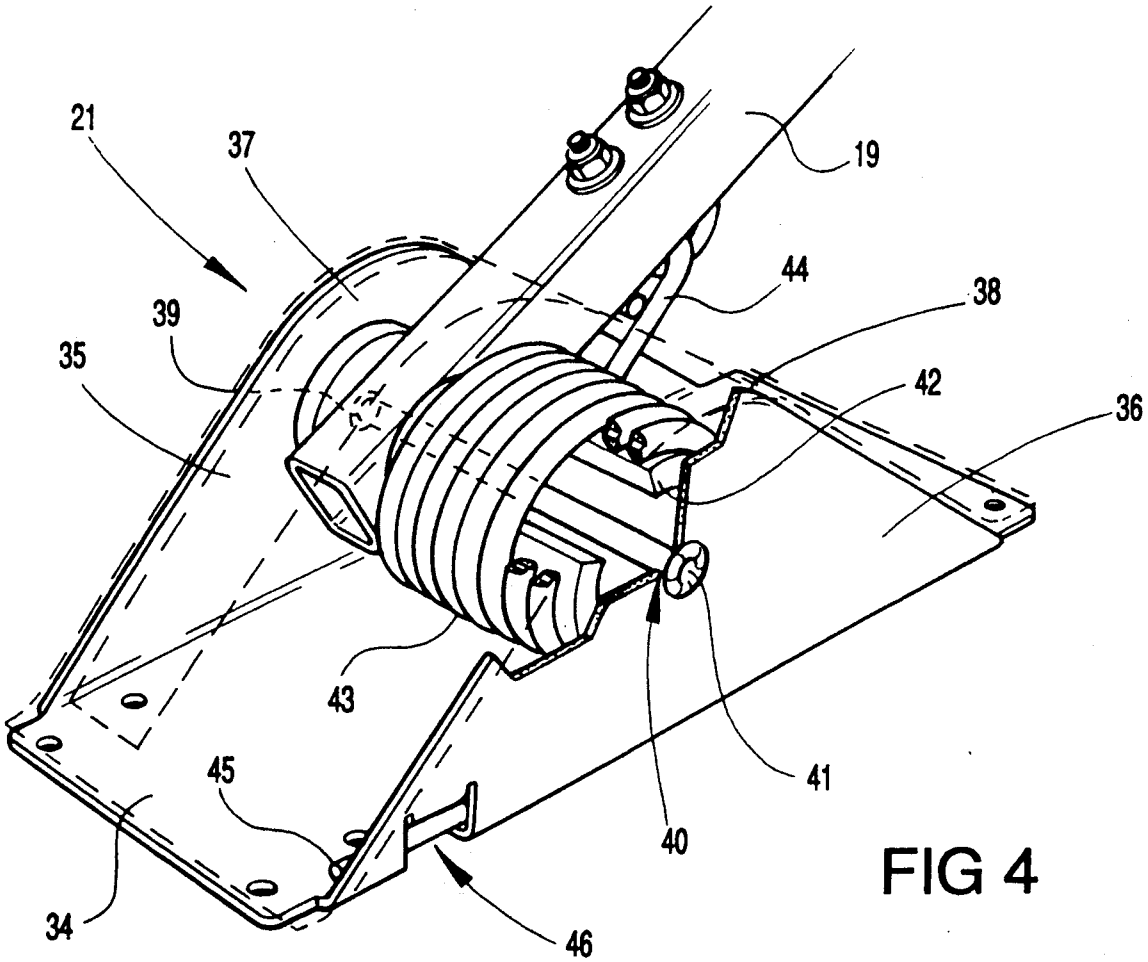
FIG. 4 is an enlarged perspective view of the resilient biasing means of the counterbalance mechanism of a further embodiment of the invention.
Figure 5:
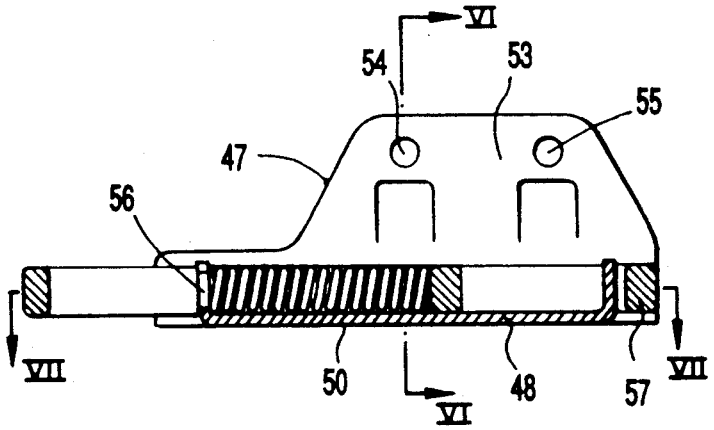
FIG. 5 is a sectional side view of a buffer forming part of the embodiment of FIGS. 1 to 3.
Figure 6:
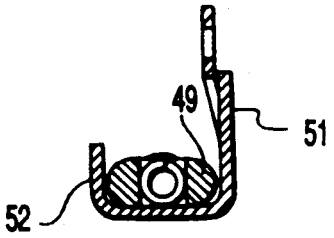
FIG. 6 is a section taken on the line VI—VI of FIG. 5.

As can be seen in FIG. 4, in the alternative embodiment the counterbalance mechanism 21 comprises a mounting bracket 34 having two upstanding generally triangular side walls 35, 36 each having a rounded curved apex 37, 38 respectively and in each of which is formed a respective aligned aperture 39, 40 housing a spindle 41 which pivotally connects the arm 19 to the bracket 34. Around the spindle 41 is located a resilient elastomeric sleeve 42 which in turn is surrounded by a coil spring 43 one end 44 of which is formed as a hook engaged over the arm 19, and the other end of which, identified with the reference numeral 45. is engaged in an opening 46 in the side wall 36. As in the embodiment shown in FIG. 3, a cover 47 is fitted over the coil spring 43 to protect it from dust and/or damage by impact.

When the loft ladder is to be lowered from the raised position such as that shown in FIG. 2, the trap door 25 is opened by release of the bolt 27 allowing it to turn about the hinge 26. The lower end of the upper ladder section 12 may be engaged by a suitable tool (if the ceiling height is too great for a user to grasp the lowermost rung whilst standing on the ground) and drawn downwardly turning the whole ladder 11 about the pivot 16 and causing the arm 19 to be turned in an anticlockwise direction about the pivot 41. At this point the spring 43 is only lightly stressed and exerts a minimum restoring force, which increases gradually as the ladder turns about the pivot 16 and slides through the guide 17 so that a greater proportion of its weight is transferred to the left hand side of the pivot 16 and gradually an increasing proportion of the weight of the ladder comes to exert an anti-clockwise moment about the pivot 16. As this movement progresses there will come a point when the upper section of the ladder 12 has moved through the guide 17 to a point where that part of the ladder 11 exerting an anti-clockwise moment about the pivot 16 is greater than the remaining part of the ladder 11 which is exerting a clockwise moment about the pivot 16, and in the embodiment of FIG. 4 the spring 43 and sleeve 42 are so dimensioned that it is at this point that the coils of the spring 43 which are reduced in diameter as the spring is stressed by anti-clockwise rotation of the arm 19 comes into contact with the sleeve 42 so that the restoring force of the spring 43 is increased by a step function due to the fact that the turns of the spring can no longer reduce in diameter without also compressing the sleeve 42 so that the resilient compression of the sleeve 42 adds to the restoring force exerted by the spring 43. The weight of the ladder is thus substantially entirely borne by the counterbalance mechanism 21 as the ladder section 12 slides through the final part of the movement to the position illustrated in FIG. 1. At this point the catches 28, 29 can be released to allow the ladder sections 13 and 14 to be extended by sliding with respect to one another and to the upper ladder section 12 to bring the ladder 11 to the fully extended position illustrated in FIG. 1, at which point the catches 28, 29 are re-engaged. In arriving at this fully extended position the ladder 11 is free to move about the pivot 16 through a limited angle permitted by the link 22 so that it can be readily positioned precisely as the user wishes. Collapse of the ladder to the stowed position is effected by reversing these operations, first raising the ladder sections 14 and 13 to a locked position with respect to the ladder section 12, and finally lifting the whole ladder assembly, with the assistance of the counterbalance mechanism into the stowed position. Again, as the ladder passes the intermediate position where the majority of its weight is borne by the pivot 16, the restoring force exerted by the counterbalance mechanism 21 falls as the effect of the resilient sleeve 42 is reduced upon enlargement of the turns of the coil spring 43 so that the last part of the movement of the ladder 11 is effected with a smaller biasing force and will thus move smoothly into position without snatching and jerking. Finally, as the ladder reaches the fully stowed position its movement is arrested smoothly without any jarring impact by engagement of the buffer 47 against the guide 17.

Figure 7:
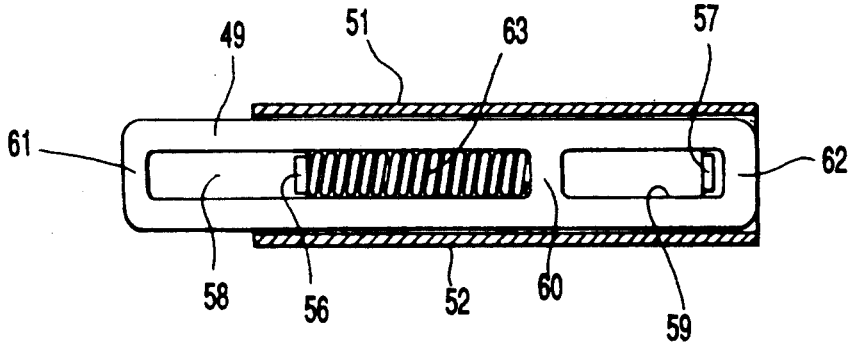
FIG. 7 is a section taken on the line VII—VII of FIG. 5.
Figure 8:
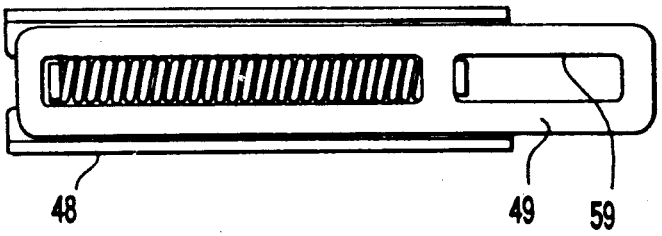
FIG. 8 is a sectional view similar to FIG. 7, showing the buffer in a different operational condition.

FIGS. 5 to 8 illustrate a preferred embodiment of the buffer 47 which comprises a buffer housing 48 in the form of an open channel of one-piece construction having a bottom wall 50, a rear wall 51 and a front wall 52. The rear wall 51 has a flange extension 53 through which pass two apertures 54, 55 by which the housing can be attached to a ladder stile. At each end of the channel the bottom wall 50 is formed with a right angle tongue 56, 57. The buffer slide member 49 is a substantially rectilinear body having a first slot 58 extending over approximately two thirds of its length and a second slot 59, coaxial with the first, and extending over just less than one third of the length of the body 49. The two slots 58, 59 are separated by a partition wall 60 and defined at each end of the body 49 by respective end walls 61 (defining the end of the slot 58) and 62 (defining the end of the slot 59). The slide member 49 is engaged within the channel defined by the bottom wall 50 and side walls 51, 52 with the dividing wall 60 located between the end tab 56 and the dividing wall 60 to urge the slide member 49 to the right as shown in FIGS. 7 and 8. The buffer is shown with the slide member 49 projecting from the housing in FIG. 8, in the maximum extended position which it adopts when unstressed by contact with the guide 17, and in FIG. 7 is shown in the position of maximum compression with the end wall 62 displaced entirely into the channel of the buffer housing in the position it would adopt in a fully stowed position illustrated, for example, in FIG. 2.

Reference will now be made to the bolt catches 28, 29 and their engagement with the ladder sections. It will be understood that, in the ladder embodiment shown in FIGS. 1 to 3 the engagement between two adjacent ladder sections relies entirely on the shear force exerted on the bolt catch by adjacent flanges of adjacent ladder sections. Although the bolt may be made of sufficiently thick material to resist such shear forces, the material of the flanges is relatively thin and may be subject to tearing if excessive loads are applied.

Figure 9:
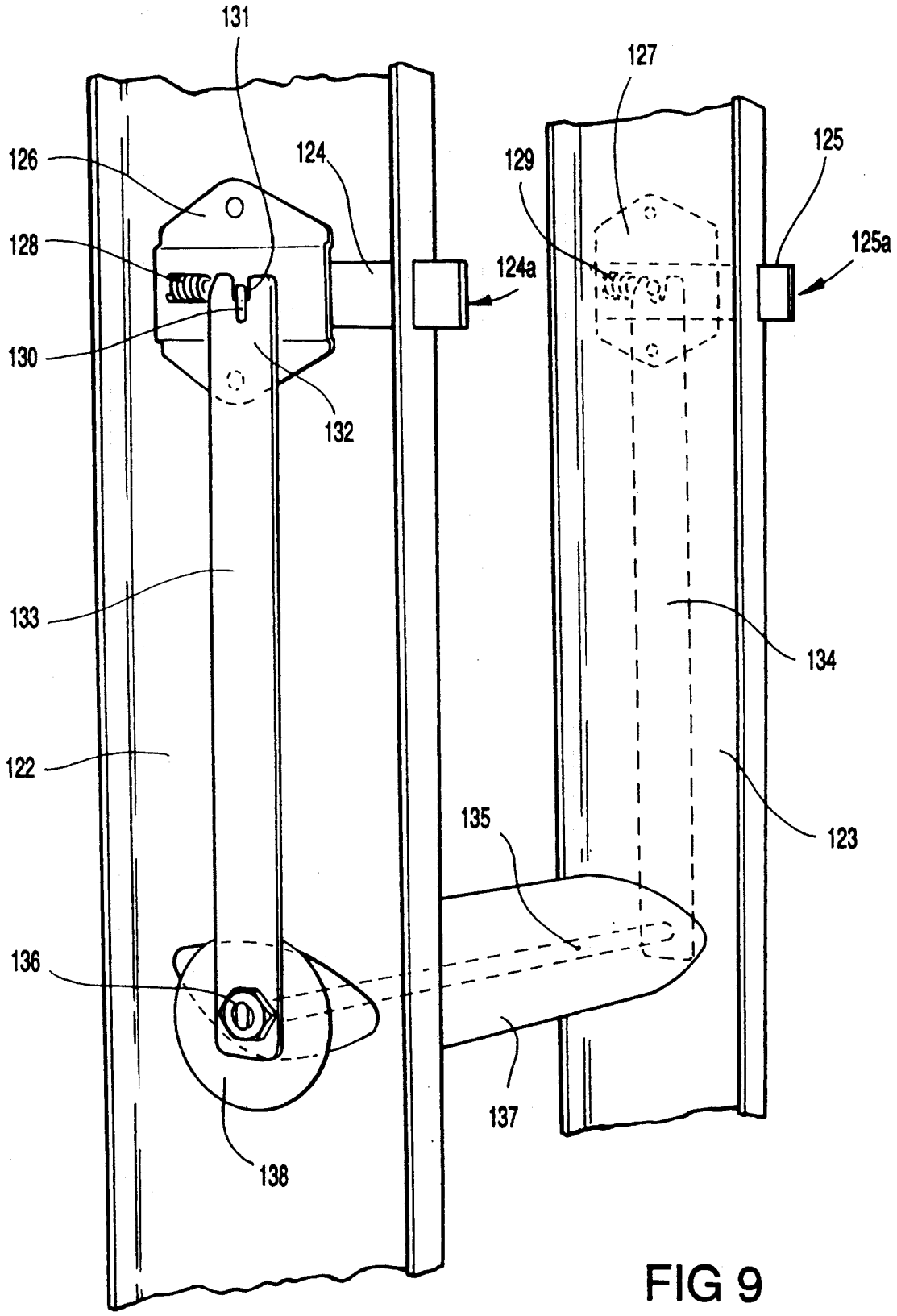
FIG. 9 is a perspective view illustrating the double-catch arrangement of the present invention.

FIG. 9 illustrates a part of an embodiment of the present invention in which, without increasing the material thickness, a stronger interengagement between the bolt catch and the flanges may be achieved.

As shown in FIG. 9, two stiles 122, 123 of a ladder section are each provided with a respective rectilinearly displaceable bolt catch 124, 125 slidably mounted on a respective catch base, 126, 127 and resiliently biased by a spring 128, 129 towards the projecting or engaged position.

Each bolt catch 124, 125 has a transverse projection (only one of which is visible in FIG. 9, identified with reference numeral 130) engaged by a slot 131 defined by a bifurcated end 132 of a respective lever arm 133, 134. The two lever arms 133, 134 are secured fixedly to opposite ends of a torsion rod 135 and secured in place by a nut 25. As can be seen in FIG. 9 the torsion rod 135 passes through a hollow rung 137 of the ladder, which spans the stiles 122, 123. A cover or cap 138, which also serves as a pivot mount for the torsion bar 135, covers the opening in the stile through which the torsion bar projects at each end.

As will be appreciated readily from a review of FIG. 9, when it is desired to withdraw the catch bolts 124, 125 from the engaged position to which they are biased by the springs, 128, 129 it is necessary only to act on one or other of the levers 133, 134 to cause it to turn about the pivoted end joined to the torsion bar 137. The turning moment exerted by this movement is transmitted, without any significant lost motion due to tolerances, to the other of the two lever arms and from this to the other catch bolt thereby causing this also to withdraw by the same distance. In terms of the dimensions involved, a ladder is normally less than about 0.5 meters wide with approximately the same distance between adjacent rungs so that the lost motion from one catch to the other, due either to beam deflection of the levers 133, 134 or torsional deflection of the torsion bar 137, is insignificantly small such that it can be considered that both the bolt catches 124, 125 move in synchronism and by substantially the same distance. Any lost motion between the movement of the two bolt catches is well within the tolerances of manufacture and can be accommodated by ensuring that the fully retracted position of each bolt is such that the very end or nose 124*a* (of the bolt 124) or 125*a* (of the bolt 125) is withdrawn beyond the flange of the associated stile so as to cause displacement of the other of the catch bolts to a position in which the engaged flange is certainly released.

When manipulating a loft ladder or other extending ladder it is only necessary for the operator to use one hand to release the catches and/or to maintain them in the released position, leaving the other hand free to manipulate the other ladder sections without hinderance.

We claim:

1. A loft ladder of the type having a slidably pivotal connection to a loft opening and a counterbalance mechanism including a resiliently biased pivoted arm with a two-stage action, wherein said two-stage action is achieved by the provision of a helical coil spring acting in torsion about the axis of the coil and enclosing a resilient sleeve which is gripped when the coil spring is reduced in diameter upon flexing.

2. A loft ladder having pivotal slide coupling means for mounting it to a loft opening and counterbalance mechanism with a resiliently biased pivoted arm, wherein a handrail of said loft ladder is supported on said ladder on a section thereof by spacers allowing said handrail to be carried at a lateral distance from the stile greater then the lateral space occupied by the counterbalance mechanism whereby to allow both the counterbalance mechanism and the handrail to be fitted to the same side of the loft ladder if desired.

3. An extended ladder comprising at least two ladder parts constituted by two stiles interconnected by rungs, the parts being relatively movable between a fully extended position and a collapsed position, and at least one releasable catch for retaining said ladder parts in at least one relative position selected from said fully extended position and at least one partly extended position, wherein there are provided two movable catch members mounted on respective stiles of one of said ladder parts, and interconnection means linking said movable catch members such that displacement of one member is transmitted to the other whereby to release the two ladder parts for relative movement or to connect them together in a selected relative position.

4. An extending ladder as claimed in claim 3, wherein said stiles define respective catch openings and each said catch member has a nose portion engageable in at least one cooperating said catch opening in the corresponding stile of the other ladder part.

5. An extending ladder is claimed in claim 3, wherein each said catch member is rectilinearly displaceable between a first, engagement position and a second, release position.

6. An extending ladder as claimed in claim 3, wherein each said catch member is angularly displaceable between a first, engagement position and a second, release position.

7. An extending ladder as claimed in claim 3, wherein said ladder has at least one tubular rung and said interconnection means pass through a said tubular rung of the ladder from one stile to the other.

8. An extending ladder as claimed in claim 7, wherein said interconnection means include a torsion member selected from a torsion bar and a torsion tube.

9. An extending ladder as claimed in claim 8, wherein a lever arm is provided to operate said torsion member whereby to cause displacement of said catch members between a first, engagement position and a second, release position thereof.

10. An extending ladder as claimed in claim 9, wherein said lever arms are formed as operating handles for said catch members.

11. An extending ladder as claimed in claim 3, wherein said catch members comprise resiliently biased sliding bolts engaged by said interconnection means for operation thereon.

12. A loft ladder of the type having counterbalancing means including a resiliently biased pivotal arm and being adapted to be pivotally and slidably mounted to a loft opening for movement between a stowed position and a lowered position, said pivotal arm having a free end connected to the loft ladder by a link member pivotally connected at one end to said pivotal arm and at the other end to said loft ladder, whereby to allow said loft ladder to turn abut its pivotal connection to said loft opening over at least a limited extent when the loft ladder is in said lowered position, said link member comprising two link elements positioned one on either side of said pivotal arm, said link elements being joined together by pivotal connectors, said pivotal connectors also connecting link elements to said pivotal arm and to said loft ladder.

13. A loft ladder as claimed in claim 12, wherein said resiliently biased pivotal arm is biased by a two-stage spring offering a greater biasing force when said arms is in a position where it largely supports the weight of said loft ladder and a reduced biasing force when said loft ladder is close to said stowed position, wherein said two-stage action is provided by a helical coil spring acting in torsion about the axis of the coil, and wherein said helical coil spring has a central core constituted by a material selected from resilient elastomeric and plastic materials, said core being gripped by said helical coil spring as it is reduced in diameter upon flexing.

14. A loft ladder of the type having counterbalancing means including a resiliently biased pivotal arm and being adapted to be pivotally and slidably mounted to a loft opening for movement between a stowed position and a lowered position, said pivotal arm having a free end connected to the loft ladder by a link member pivotally connected at one end to said pivotal arm and at the other end to said loft ladder, whereby to allow said loft ladder to turn about its pivotal connection to said loft opening over at least a limited extent when the loft ladder is in said lowered position, said counterbalancing means occupying space laterally of said loft ladder and said loft ladder having a handrail supported thereon at a lateral distance from a stile thereof which is greater than said lateral space occupied by the counterbalancing means whereby to allow both said counterbalancing means and said handrail to be fitted to the same side of said loft ladder.

15. A loft ladder as claimed in claim 12, wherein the resiliently biased pivotal arm is biased by means of a coil spring in torsion.

* * * * *